US011913475B2

(12) United States Patent
Botkin et al.

(10) Patent No.: US 11,913,475 B2
(45) **Date of Patent: *Feb. 27, 2024**

(54) CEILING FAN AND BLADE

(71) Applicant: Hunter Fan Company, Memphis, TN (US)

(72) Inventors: Charles William Botkin, Cordova, TN (US); Bobby Neal Norwood, Oakland, TN (US); James Walter Longmire, Humboldt, TN (US); Douglas Troy Mason, Horn Lake, MS (US); Seth Aaron Wood, Bartlett, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/162,648

(22) Filed: Jan. 31, 2023

(65) Prior Publication Data

US 2023/0175528 A1 Jun. 8, 2023

Related U.S. Application Data

(63) Continuation of application No. 17/540,620, filed on Dec. 2, 2021, now Pat. No. 11,603,863, which is a (Continued)

(51) Int. Cl.
*F04D 29/64* (2006.01)
*F04D 19/00* (2006.01)
(Continued)

(52) U.S. Cl.
CPC ..... *F04D 29/646* (2013.01); *F04D 19/002* (2013.01); *F04D 25/088* (2013.01); *F04D 29/38* (2013.01); *F04D 29/388* (2013.01)

(58) Field of Classification Search
CPC ..... F04D 19/002; F04D 25/088; F04D 29/38; F04D 29/388; F04D 29/646
See application file for complete search history.

(56) References Cited

U.S. PATENT DOCUMENTS 2,251,887 A * 8/1941 Larsh ..... F04D 29/382 416/240
3,665,625 A 5/1972 Moss
(Continued)

FOREIGN PATENT DOCUMENTS

CN 1101107 A * 4/1995
CN 102900696 A 1/2013
(Continued)

OTHER PUBLICATIONS

Screen captures from YouTube video clip entitled "Homemade 13" Cardboard Mini Ceiling Fan, 4 pages, uploaded on Feb. 9, 2014 by user "Baltimore Alarms & Fans." Retrieved from Internet: <http://www.youtube.com/watch?v=n5pbNasJfa4>. (Year: 2014).

*Primary Examiner* — Audrey B. Walter
(74) *Attorney, Agent, or Firm* — McGarry Bair PC

(57) ABSTRACT

A blade for a ceiling fan can include a first half and a second half formed from a pulp material. The first half is attachable to the second half to form the blade. Additionally, a blade can include a skeleton with an over molding made from a pulp forming the blade. Furthermore, a blade can be formed using a blade base with a pulp topper added to the blade to form an aerodynamic shape for the blade.

16 Claims, 11 Drawing Sheets

Related U.S. Application Data continuation of application No. 16/728,302, filed on Dec. 27, 2019, now Pat. No. 11,215,198.

(51) Int. Cl.
*F04D 29/38* (2006.01)
*F04D 25/08* (2006.01)

(56) References Cited

U.S. PATENT DOCUMENTS

| | | | |
|---|---|---|---|
| 5,601,409 | A | 2/1997 | Huang |
| 6,019,479 | A | 2/2000 | Barker |
| 6,146,097 | A | 11/2000 | Bradt |
| 7,665,967 | B1 | 2/2010 | Parker et al. |
| 7,927,071 | B2 | 4/2011 | Parker et al. |
| 8,167,574 | B2 | 5/2012 | Ko |
| 2002/0094273 | A1 | 7/2002 | Huang |
| 2003/0190233 | A1 | 10/2003 | Chiang |
| 2004/0001755 | A1 | 1/2004 | Lee |
| 2004/0187691 | A1 | 9/2004 | Lee |
| 2009/0263254 | A1 | 10/2009 | Bucher |
| 2017/0021462 | A1 | 1/2017 | Chiang et al. |
| 2019/0192719 | A1 | 6/2019 | Drayton et al. |

FOREIGN PATENT DOCUMENTS

| | | | |
|---|---|---|---|
| CN | 209724783 | U | 12/2019 |
| KR | 200290110 | Y1 | 9/2002 |

* cited by examiner

CEILING FAN AND BLADE

CROSS-REFERENCE TO RELATED APPLICATION

This application claims priority to U.S. patent application Ser. No. 17/540,620, filed Dec. 2, 2021, which is a continuation of U.S. patent application Ser. No. 16/728,302, filed Dec. 27, 2019, now U.S. Pat. No. 11,215,198, all of which are incorporated herein by reference in their entirety.

BACKGROUND OF THE INVENTION

Ceiling fans traditionally include a set of blades rotatably coupled to a motor assembly to rotate the set of blades. Rotation of the set of blades drives a volume of fluid, typically ambient air within a room, space, or area.

Ceiling fan blades include a traditional aesthetic, commonly having a flat bottom on the blade which provides consumers with a traditional ceiling fan style. However, the flat blades are somewhat aerodynamically inefficient in comparison to other aerodynamic blade shapes.

BRIEF DESCRIPTION OF THE INVENTION

In one aspect, the disclosure relates to a ceiling fan assembly comprising: a motor; a mount for coupling to a structure and for suspending the motor; a ceiling fan blade comprising a blade body for coupling to the motor, wherein the ceiling fan blade is formed from a molded pulp and includes a skeleton, and the molded pulp is formed about at least a portion of the skeleton.

In another aspect, the disclosure relates to a ceiling fan assembly comprising: a motor; a mount for coupling to a structure and for suspending the motor; a ceiling fan blade comprising a blade body for coupling to the motor, wherein the ceiling fan blade is formed from a molded pulp, and includes a foam core, and the molded pulp is formed about at least a portion of the foam core.

In yet another aspect, the disclosure relates to a ceiling fan assembly comprising: a motor having a rotor with a blade mount; a mount for coupling to a structure and for suspending the motor; and a ceiling fan blade comprising a molded pulp blade body made of a molded pulp slurry.

DETAILED DESCRIPTION OF EMBODIMENTS

Figure 1:
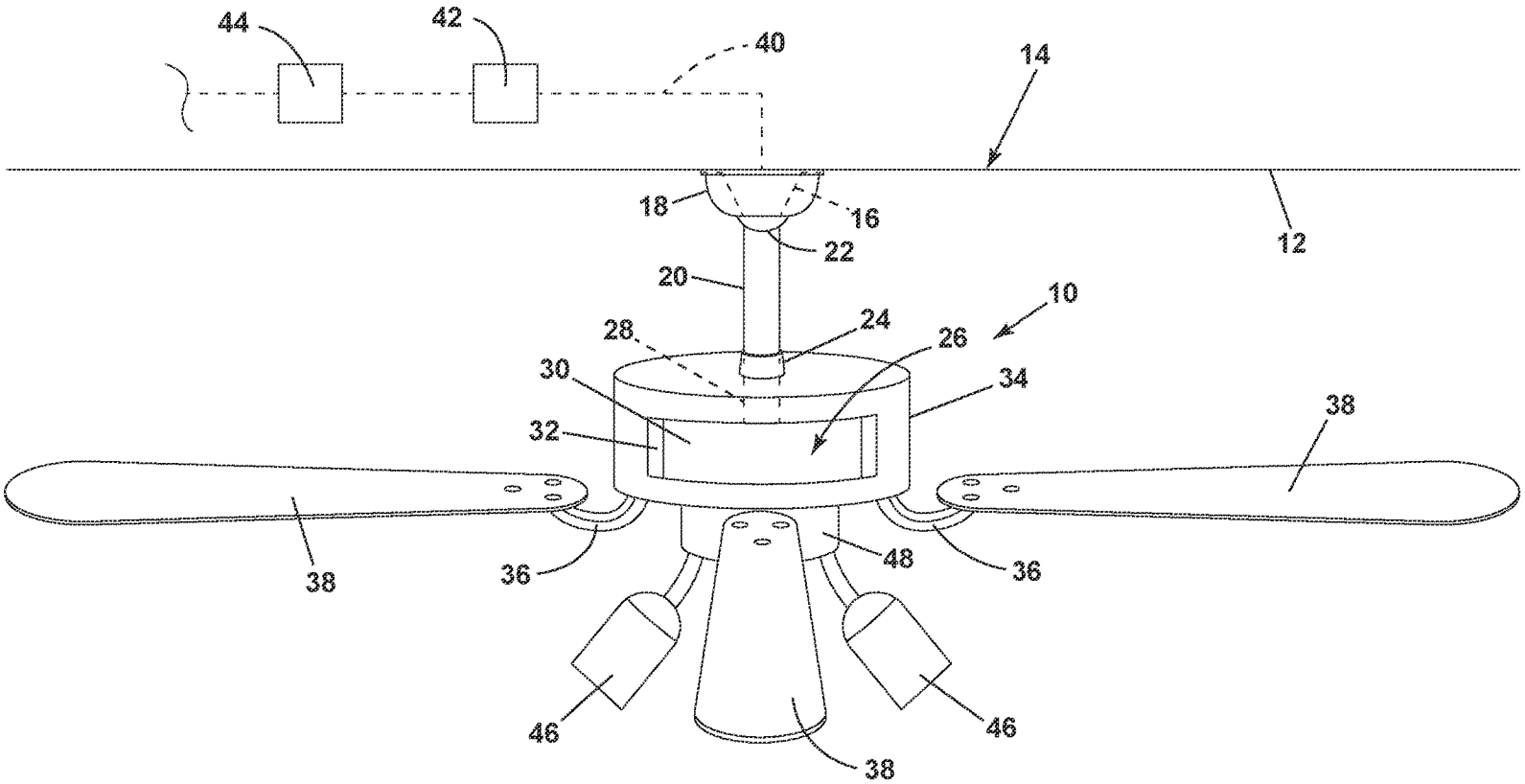
FIG. 1 is a partial schematic view of a ceiling fan having a set of blades suspended from a structure.

The disclosure herein relates to a pulp ceiling fan blade and a molded pulp ceiling fan blade. A pulp ceiling fan blade can be a ceiling fan blade that is at least partially made from a pulp. A molded pulp ceiling fan blade can be any ceiling fan blade that is made from a pulp, where the pulp is formed and then molded into a desired ceiling fan blade shape, or component thereof. Thus, a molded pulp product must be formed by shaping or molding the pulp, as opposed to cutting a product from a volume of material formed from pulp. More specifically, a molded pulp ceiling fan blade can be made from a slurry or unit of pulp, which is then compressed, stamped, molded, or otherwise formed into the desired ceiling fan blade shape, or portion thereof. As such, it should be appreciated that a molded pulp product or a molded pulp ceiling fan blade is different than a product formed from combined fibers with binders to form a sheet or board, which is then cut to the desired dimension, shape, or size.

The disclosure provided herein relates to blades, and more specifically, to blades for a ceiling fan or other air moving device for generating an airflow, often for local cooling, heating, or air conditioning. The blades provided herein relate to a blade formed at least partially with a volume of pulp, such that at least a portion of the blade is made from pulp, providing for decreased costs, weight, and environmental impact, among other benefits. It should be understood that it is contemplated that other ceiling fan elements, components, or parts can be made from a pulp, including but not limited to, blades, blade irons, motor housings, switch housings, light kit fixtures or housings, motor adapters, downrods, canopies, or mounts. While the description herein is directed toward a ceiling fan blade specifically, it should be appreciated that the pulp ceiling fan element can be applied to any suitable ceiling fan component.

'Pulp' as generally described herein can be defined as the material utilized in forming, making, or otherwise creating molded pulp products (MPPs). MPPs can include, but are not limited to, thermoformed molded pulp products, molded pulp products, impulse-dried pulp products, while other types of forming or molding, such as compression of the pulp are contemplated. Pulp can also include fiber which is formed to create the final product, often through wetting or dampening, forming, and then shaping and drying. Such pulp or molded pulp products can, but need not include, wood fibers or other cellulose, other plant-based fibers, or paper, in non-limiting examples. Additionally, it is contemplated that components such as chemical components can be added to the pulp or pulp mixture to impart performance characteristics, such as improved efficiency. Such examples of MPPs can be found in U.S. Pat. No. 9,856,608, which is incorporated herein by reference in its entirety. Most common known types of MPPs are drinker carriers, egg cartons, or other serving trays or food containers, while an increase in industrial packaging or disposable items formed by molded pulp is being seen. Particularly those involving the use of recycled paper products. Additionally, alternative materials to pulp or a molded pulp product can include a foam, such as polystyrene in one non-limiting example, which can be utilized in place of pulp to form the products and fan blades as described herein, as well as other pulp alternatives including foams, plastics, or other suitable materials.

As used herein, the term "set" or a "set" of elements can be any number of elements, including only one.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring to FIG. 1, an exemplary ceiling fan 10 is mounted to a ceiling 12 of a structure 14, such as in a residential home. Alternatively, the ceiling fan 10 can be mounted or suspended in a myriad of environments, such as on a ceiling or wall, in a residential space or home, outdoor or indoor, in an industrial setting, such as a manufacturing plant, or in an agricultural setting, in non-limiting examples.

The ceiling fan 10 includes a mount 16 suspending the ceiling fan 10 from and coupling the ceiling fan 10 to the ceiling 12. A canopy 18 covers the mount 16. A downrod is suspended from the mount 16 by a ball 22. A motor adapter 24 secures the downrod 20 to a motor 26 via a motor shaft 28 extending from the motor 26. The motor 26 can include a stator 30 mounted to the motor shaft 28, as well as a rotor 32 rotatably driven about the stator The motor adapter 24 can further couple to a motor housing 34 at least partially encasing the motor 26. A set of blade irons 36 couples a complementary set of blades 38 to the rotor 32 for rotating the blades 38 and driving a volume of fluid, such as air, about the structure 14 or a local room therein. A switch housing 48 can mount below the motor housing 34 and electrically couple to the motor 26. A light kit 46 can electrically and mechanically couple to the switch housing 48.

It should be understood that the ceiling fan 10 as depicted in FIG. 1 is by way of example only, and it should be understood that more or less components than those shown and described can be included with the ceiling fan 10, and such variation among ceiling fan assemblies is within the scope of this description.

The ceiling fan 10 can be coupled to a power supply 40, such as a building electrical supply. The power supply 40 may be connected to one or more controllers 42 or switches 44. The controllers 42 can be used to receive or send information related to the control and operation of the ceiling fan 10, such as over a wired or wireless signal. The switches 44, can be operated to control the ceiling fan 10, such as a wall-mounted switch, for example. While the controller 42 and the switch 44 are schematically shown exterior of the ceiling 12, it should be appreciated that the controller 42 and the switch 44 may be optional, or may be provided in other positions, such as on the wall or ceiling, or within portions of the ceiling fan 10 itself.

While the ceiling fan as shown in FIG. 1 and as described herein is a 'standard mount' including the mount 16 suspending the downrod 20, and suspending the motor 26 therefrom, it should be understood that any suitable ceiling fan assembly is contemplated. For example, any suitable mount can be used, such as a traditional mount, a 'hugger' mount which hugs up against the ceiling, also referred to as a low-profile ceiling fan. Additionally, it is contemplated that a ceiling fan can be used with or without a downrod suspending the motor assembly. It should be understood that the disclosure need not be limited by the particular components of a particular ceiling fan assembly. Similarly, while FIG. 1 shows the use of blade irons 36 that extend external of the motor housing from the rotor to the blade, it should be appreciated that other blade mounting methods or styles are also contemplated. For example, blades that directly mount to the rotor are contemplated, along with various different types of blade irons or different material, including but not limited to aluminum, zinc, copper, cast iron, or plastic in non-limiting examples. Furthermore, the blade iron need not be a traditional blade iron that mounts to the rotor and extends exterior of the motor housing, but can be any suitable element or system thereof that effectively fastens the blade to the motor to rotatably drive the blades.

Figure 2:
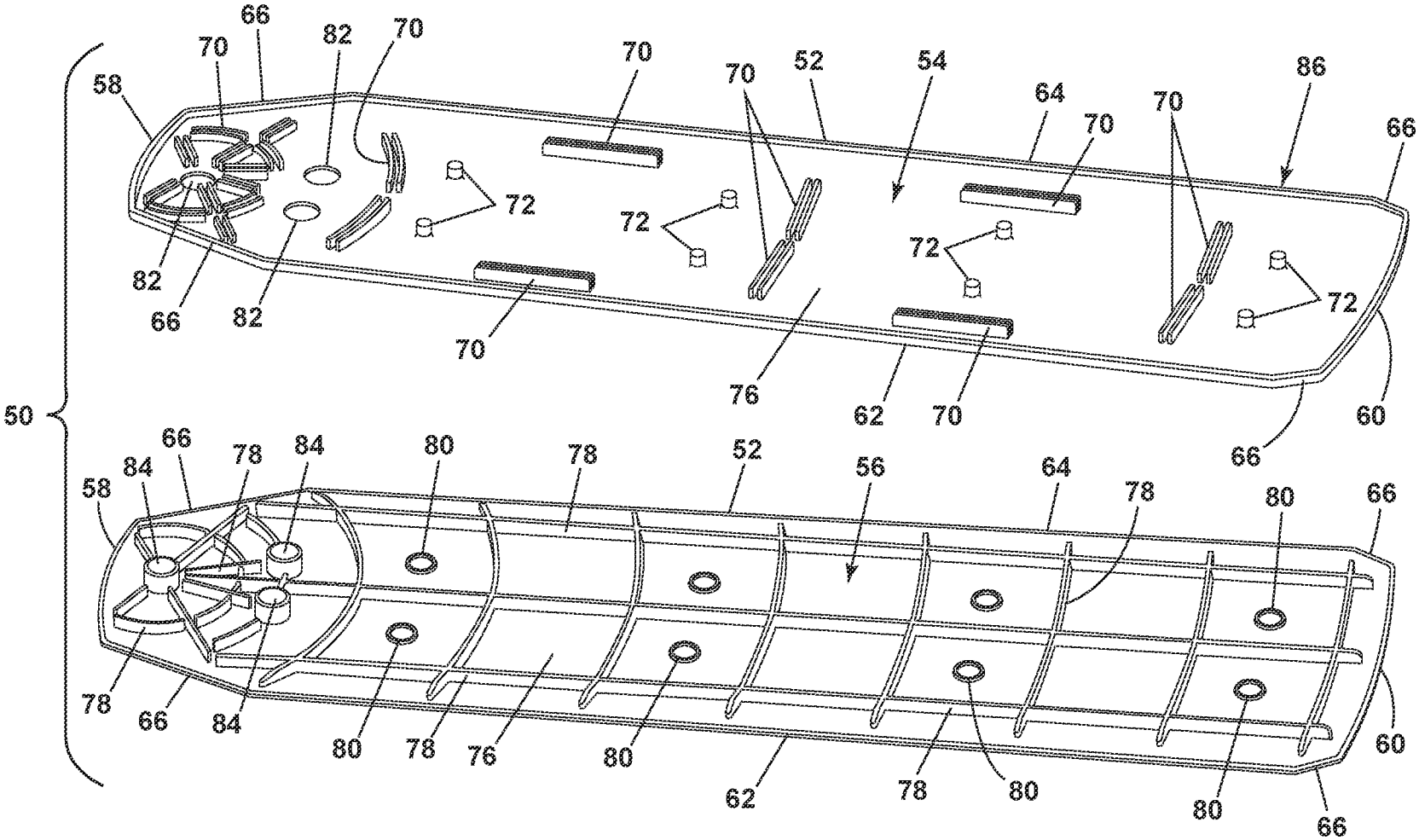
FIG. 2 is a view of a blade of the set of blades of FIG. 1, including an upper half separated from a lower half.

Turning to FIG. 2, a blade 50, which can be the blade 38 of FIG. 1, can include a body 52 separable into a first, upper half 54, and a second, lower half 56. It should be understood that the upper half is shown upside-down, such that the interior of the first half 54 of the blade 50 is visible, and that the upper half 54 and the lower half 56 effectively form two disconnected halves of a clamshell which can couple together essentially by pivoting the first half 54 as shown to meet the second half 56.

The blade 50 is illustrated with the halves 54, 56 separated showing the interior surfaces of both halves 54, 56. Both halves 54, 56 of the blade 50 include a root 58 and a tip 60, defining a span-wise direction therebetween, and include a first edge 62 and a second edge 64, defining a chord-wise direction therebetween. In one example, the first edge 62 can be a leading edge and the second edge 64 can be a trailing edge, while the rotational direction of the ceiling fan to which the blade 50 attaches may define the leading and trailing edges. Additionally, the blade 50 and the halves 54, 56 thereof can include tapered edges 66 at the junction between the root 58 and the edges 62, 64, and the tip 60 and the edges 62, 64. However, it should be appreciated that any plan-view shape (top-down shape) of the blade 50 is contemplated, and that the shape as shown with the tapered edges 66 is by way of example only.

The first half 54 includes a set of rib receptacles 70 and a set of stops 72. The rib receptacles 70 are formed as a pair of spaced extensions, which can be arranged in a particular pattern along an interior surface 76 of the first half 54. The rib receptacles 70 near the root 58 can have a shorter length, as compared to that of the rib receptacles further form the root 58. Additionally, the rib receptacles 70 near the root 58 can be curved or arcuate, and can angle away from the mount holes 82. Some rib receptacles 70 at the mount hole 82 extend radially from the mount hole 82, as is appreciable. Moving further from the root 58, some of the rib receptacles 70 can be arranged parallel to the leading or trailing edges 62, 64, while other are arranged perpendicular to the leading or trailing edges 62, 64. Additionally, it should be noted that the particular arrangement, such as curved, parallel, or perpendicular can vary or be slightly offset, while any suitable arrangement is contemplated. Similarly, the set of stops 72 can be arranged along the interior surface 76 in a predetermined pattern. The set of stops 72 can be formed as cylindrical extensions extending from the interior surface 76, while alternate shapes are contemplated.

The second half 56 includes a set of structural ribs 78 and stop receptacles 80. The structural ribs 78 can form an interconnected lattice-like web of structures, while it is contemplated that each structural rib 78 is discrete, and separated from the other ribs 78. The ribs 78 near the root 58 can be curved or arcuate, being complementary to the rib receptacles 70 for the first half 54. The ribs 78 nearer to the root 58 can have a greater curvature, as compared to the ribs 78 further from the root 78, while some of the ribs 78 can be arranged parallel or perpendicular to the edges 62, 64, similar to the rib receptacles. Additionally, some of the ribs 78 can extend radially from one or more of the mount receptacles 84.

The structural ribs 78 can be sized complementary to the spacing between each pair of rib receptacles 70, and can be arranged complementary to the pattern of the set of rib receptacles 70. In this way, attachment of the first half 54 to the second half 56 provides for both aligning the first half 54 with the second half 56, but also securing the first half 54 to the second half 56. In one example, the first half 54 can include an adhesive, such as glue or epoxy, which is provided between the rib receptacles 70, such that the adhesive can secure the first half 54 to the second half 56 when the structural ribs 78 of the second half 56 are inserted between the rib receptacles 70 of the first half 54. Additionally, it is contemplated that the adhesive can be applied to the edges of both halves 54, 56 of the blade 50 to prevent separation of the halves 54, 56 during operation of the fan. Alternative attachment methods are contemplated, such as a compression or interference fit between the ribs 78 and the rib receptacles 70, while any suitable attachment means or method is contemplated. As is appreciable, ends of the structural ribs 78 may be tapered to facilitate a varying thickness for the blade 50 extending between the first edge 62 and the second edge 64. Such tapering of the structural ribs 78 can provide for an airfoil profile, for example, for the blade 50.

The stop receptacles 80 can be sized and arranged complementary to the stops 72, such that the stops 72 abut the stop receptacles 80 when the first half 54 is connected to the second half 56. In this way, the stops 72 can maintain the proper spacing between the first and second halves 54, 56, as well as the proper blade thickness. In one example, the stop receptacles 80 can be formed as a raised annular ridge on the inner surface 76, which can receive the end of the stop 72 but resists or prevents movement of the stop 72 from the stop receptacle 80 when the first half 54 connects to the second half 56.

Additionally, the first half 54 includes a set of mount holes 82 and the second half 56 includes a set of complementary mount receptacles 84. The mount holes 82 can be configured to receive a fastener through the holes 82 and extending into the mount receptacles 84. When coupling the blade 50 to a ceiling fan motor, a blade iron, such as the blade iron 36 of FIG. 1, can be used to couple the blade 50 to the motor for rotating the blade via the mount holes 82 and the mount receptacles 84. The mount receptacles 84 can be sized with a height similar to the thickness of the blade 50 in order to maintain uniform thickness for the blade 50, as well as forming an aesthetically pleasing look and providing no aerodynamic disadvantage by being wholly contained within the interior of the blade 50.

The blade 50 as described herein can be made of pulp, or at least partially made from pulp. Forming the blade 50 from pulp provides for reduced costs of manufacture, which can be passed onto the consumer. Additionally, the pulp can provide for blades having a reduced weight, which can reduce energy requirements to operate the fan, which can reduce operational costs as well as improve operational efficiency. Furthermore, the pulp can be made from a recyclable material or a biodegradable material, such that the environmental impact from the fan is decreased, or that the environmental impact of the blades themselves is reduced or minimal. The features as described herein provide for forming the blade partially or fully from pulp. More specifically, the features provide for a structurally sound blade, which is subjected to operational stresses and bending moments. The rib receptacles the stops 72, the structural ribs 78, and the stop receptacles 80, for example, provide for maintaining the shape and structural integrity of the blade 50 during operation. Forming the blades from a pulp can result in a blade 50 that is more susceptible to deformation or bending. Utilizing the stops and ribs as described herein provides for forming the blade from the pulp material, while still maintaining the structural integrity necessary during operation.

Additionally, the blade 50, as well as any other blade described herein, can include an exterior coating 86. The exterior coating 86 can be a waterproof material, for example, preventing water damage to the pulp blades. Additionally, the exterior coating 86 can be of a material that a reduced coefficient of friction, at least as compared to that of the pulp material of the blade 50, such that aerodynamic efficiency is increased as compared to that of the blade 50 without the exterior coating 86. Furthermore, the exterior coating 86 can also be used for coloring or other design aesthetics for the blade 50. Further still, the exterior coating can be multiple exterior coatings, such as one to waterproof the pulp material, while another coating can be used to color the blade or to reduce aerodynamic drag. Thus, it should be understood that a myriad of coatings are contemplated for use with the blades as described herein.

Figure 3:
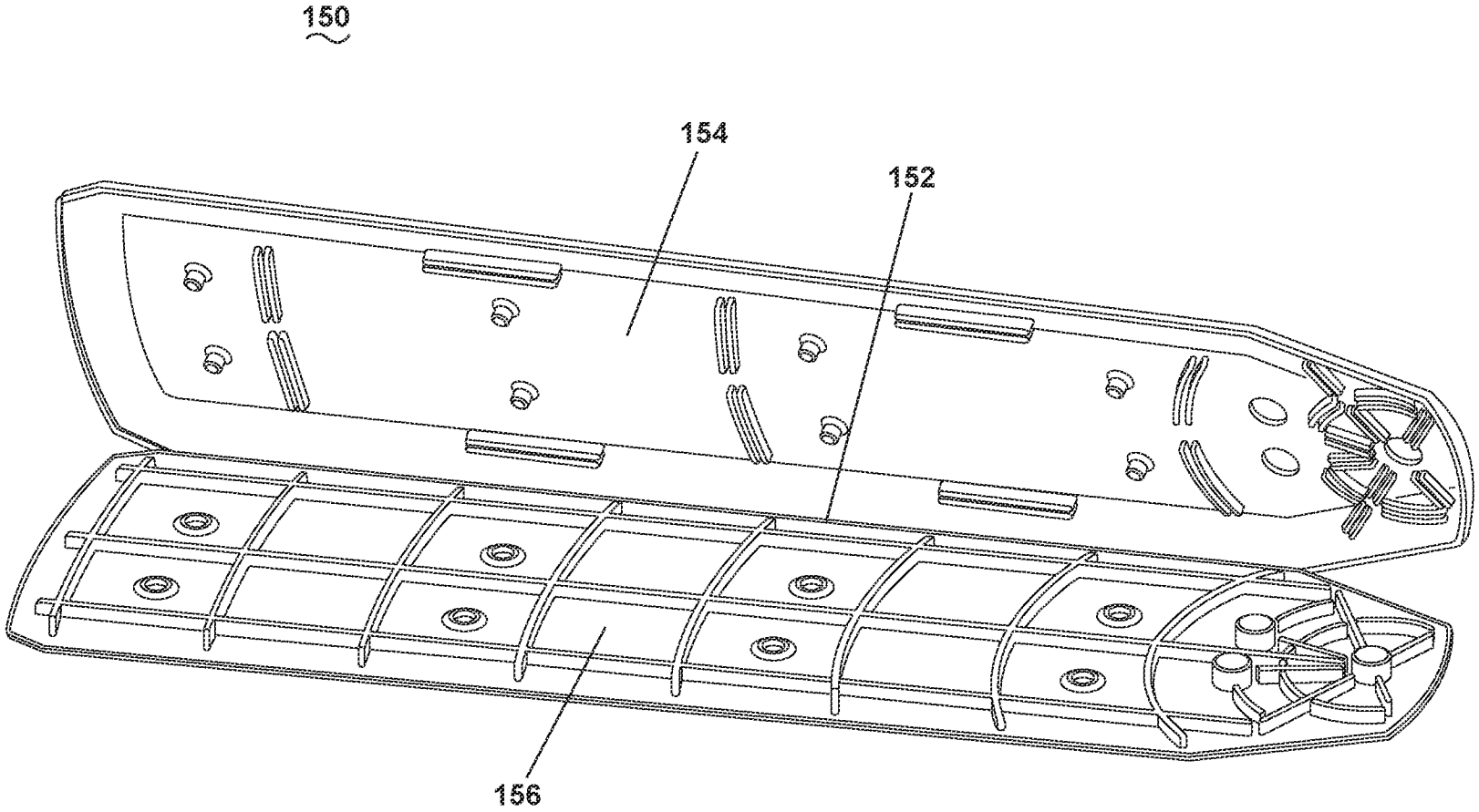
FIG. 3 is a view of alternate arrangement for the blade of FIG. 2, with the upper and lower halves connected by a hinge.

FIG. 3 depicts another blade 150 for a ceiling fan. The blade 150 can be substantially similar to the blade 50 of FIG. 2, except that the blade of FIG. 3 includes a hinge 152 which couples a first half 154 to a second half 156. In one example, the hinge 152 can be a living hinge, such that the first half 154 is integral with the second half 156, and the first half 154 can be secured to the second half 156 by bending the blade 150 along the living hinge and attaching the halves 154, 156 to one another. Thus, it should be appreciated that the halves 154, 156 as discussed herein can be mounted to one another in a variety of ways, including a living hinge where the two halves 154, 156 are formed integrally or unitarily and assembled by folding along the living hinge 152.

Figure 4:
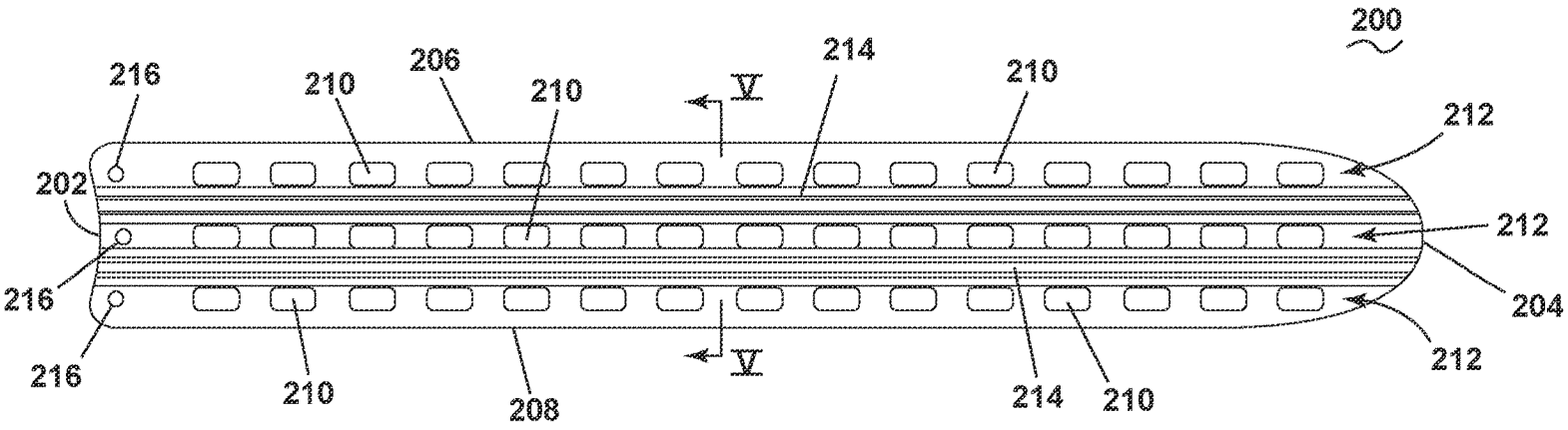
FIG. 4 is a view of another alternate arrangement for a blade of the set of blades of FIG. 1 including a skeleton.

Referring now to FIG. 4, a blade skeleton 200 for a ceiling fan blade extends between a root end 202 and a tip end 204, and between a first edge 206 and a second edge 208. The skeleton 200 can be made of stamped metal or molded plastic, in non-limiting examples, while any suitable material or manufacture method is contemplated. The skeleton 200 includes a series of perforations 210 extending along the length of the blade skeleton 200. The perforations 210 are arranged in three rows 212, with each row 212 separated by a rib 214 that extends between the root end 202 and the tip end 204. Additional mount holes 216 can be provided at the root end 202 for securing a blade iron to the skeleton 200, or securing the skeleton 200 to the motor for driving the fan blade. It should be understood that the arrangement with the ribs 214 and the perforations 210 are exemplary as shown, and can have any suitable configuration, as well as more or less elements including, but no limited to, ribs, perforations, bumps, extensions, openings, holes, grooves, channels, valleys, or any other suitable structure or lack thereof.

Figure 5:
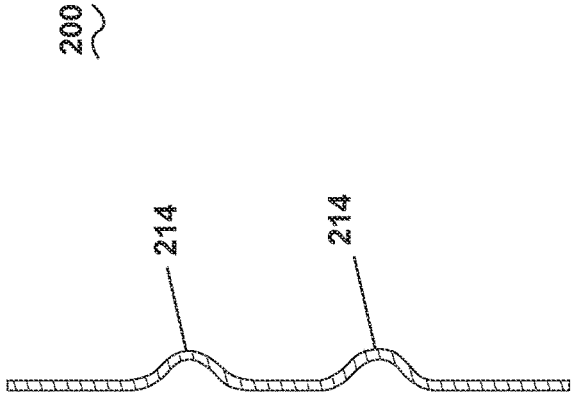
FIG. 5 is a sectional view of the skeleton of FIG. 4 taken along section V-V of FIG. 4, illustrating ribbing for the skeleton.

FIG. 5 shows a section view of the blade skeleton 200 taken along section V-V of FIG. 4, better depicting the shape of the ribs 214. The ribs 214 can include two rounded portions of the skeleton 200, which have a substantially rounded convex shape extending away from the remainder of the skeleton 200.

Figure 6:
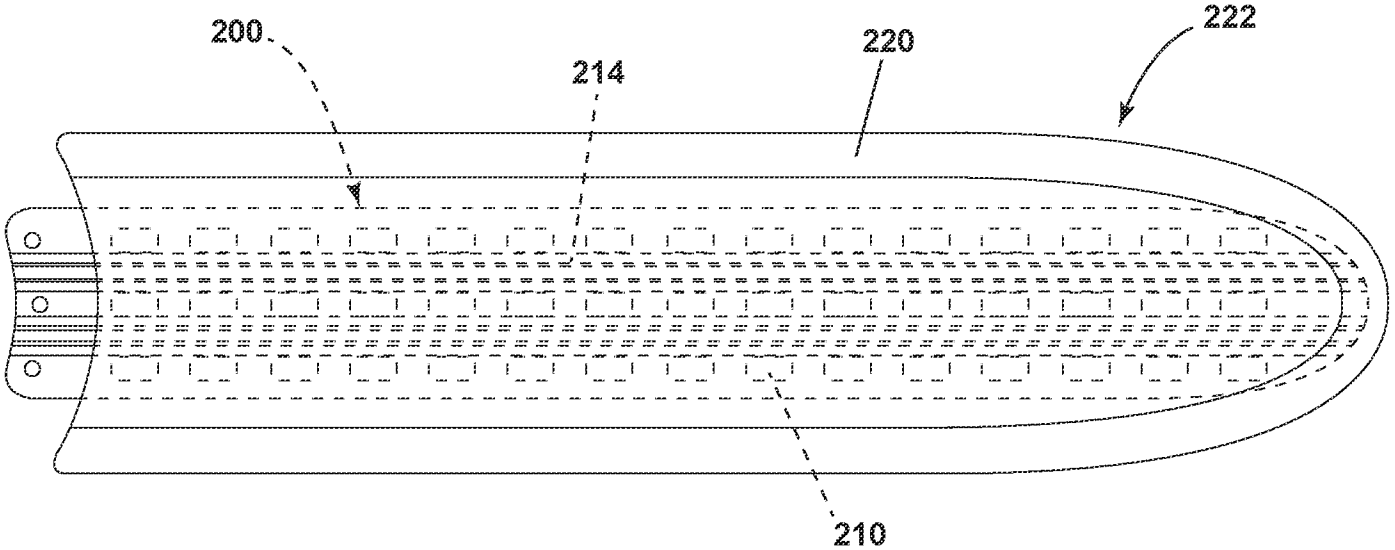
FIG. 6 is a top view of a over molding provided on the skeleton of FIG. 4.
Figure 7:
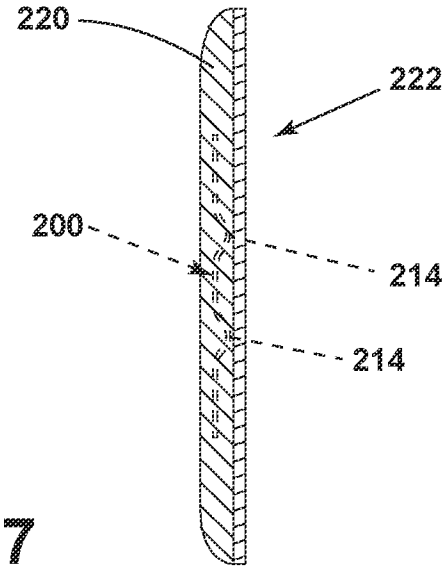
FIG. 7 is a sectional view of the skeleton and over molding of FIG. 6.

FIG. 6 includes the blade skeleton 200 having an over molding 220 forming a ceiling fan blade 222. The over molding 220 can be made from a pulp, as discussed herein, while it is also contemplated that the over molding 220 be another material, such as a foam or high-density foam in one non-limiting example. The over molding 220 can be shaped in any top-down shape, such as that shown, or of any traditional ceiling fan blade. Additionally, looking briefly at FIG. 7 showing a section view of FIG. 6, the over molding 220 can be shaped in any suitable geometry or 3D (three-dimensional) manner, such as including a performance edge profile with curved or otherwise shaped edges, or other profiles such as an airfoil profile. The profile as shown in FIG. 7 provides for improve blade performance due to the rounded edge profile, while maintaining the traditional bottom-view ceiling fan blade aesthetic with a flat bottom.

The blade 222 provides for a structurally strong blade with the skeleton 200, as well as a blade that is easy and inexpensive to produce. For example, the skeleton 200 can be easily stamped or molded. Then the over molding 220 can be molded onto the skeleton 200 to form the final blade 222. The perforations 210 in the skeleton 200, along with the ribs 214, provide for improved adhesion of the over molding 220 to the skeleton 200. Additionally, the ribs 214 provide for improved attachment of the over molding 220 to the skeleton 200 over time, as the ribs 214 help to carry and drive the over molding 220 during operation of the ceiling fan.

Figure 8:
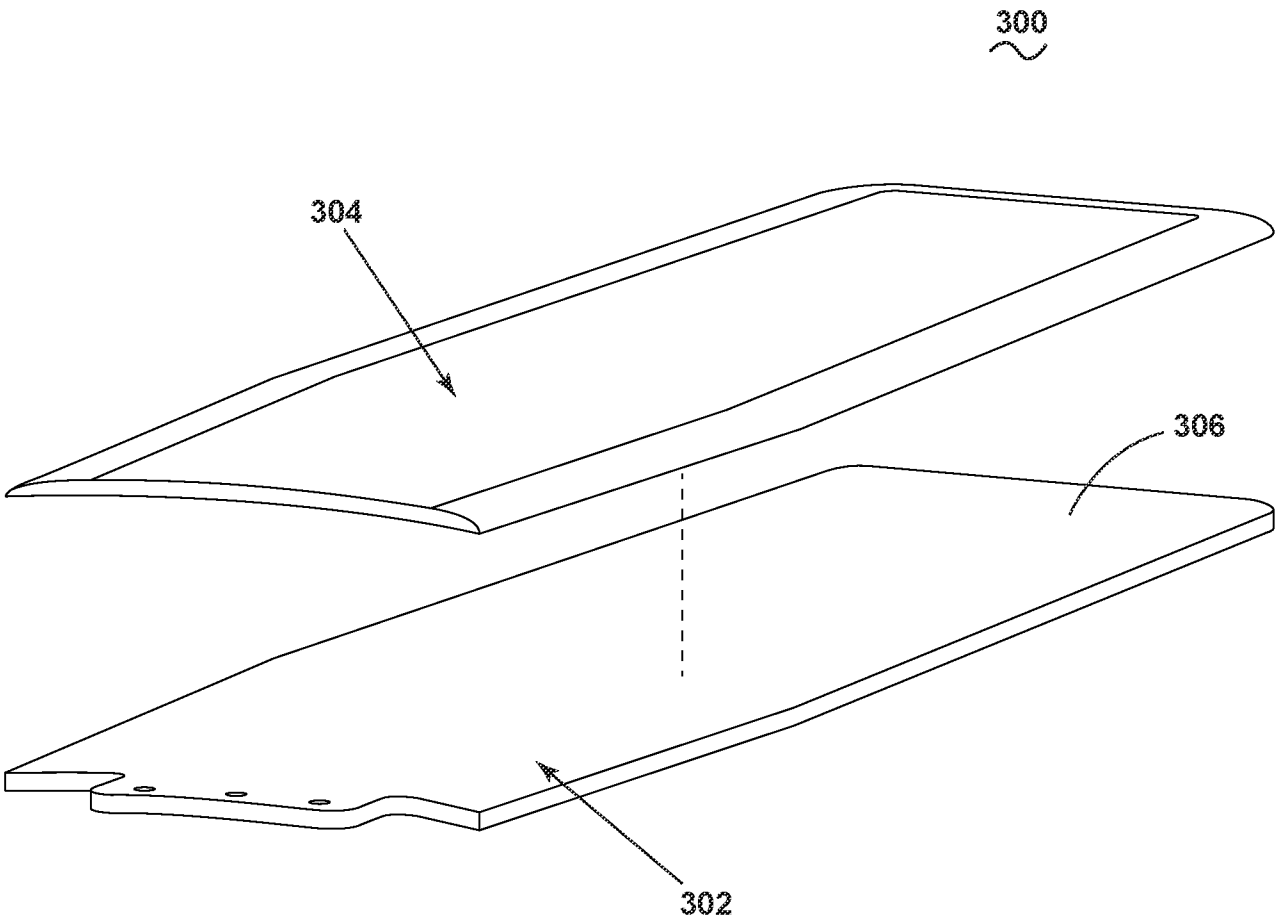
FIG. 8 is an exploded view of yet another alternative arrangement of a blade of the set of blades of FIG. 1 including a topper coupled to a top surface of a blade base.

Referring to FIG. 8, an exploded view of another exemplary blade 300 includes a blade base 302 and a topper 304. The blade base 302 can be a standard ceiling fan blade, for example, such as those traditionally manufactured with a flat top and/or flat bottom. Alternatively, the blade base 302 can be any suitable blade structure for carrying the topper 304 or upon which a topper 304 can be mounted or coupled. The topper 304 can be made from a pulp, as described herein, while additional materials are contemplated such as a foam or high-density foam. Any suitable material can be used, while preferably being lightweight while having a high tensile strength to improve overall operational efficiency. The topper 304 can be coupled to a top surface 306 of the blade base 302. The topper 304 can include or be shaped to form, upon attachment to the blade base 302, an aerodynamic profile for the blade, such as having an airfoil profile or a rounded leading edge or trailing edge to improve efficiency of the blade, at least in comparison to a blade as the blade base alone 302. Additionally, it is contemplated that the topper 304 can include a blade skeleton, such as that shown in described in relation to FIG. 4, or a wire frame such as that shown and described in relation to FIG. 11 below.

Figure 9:
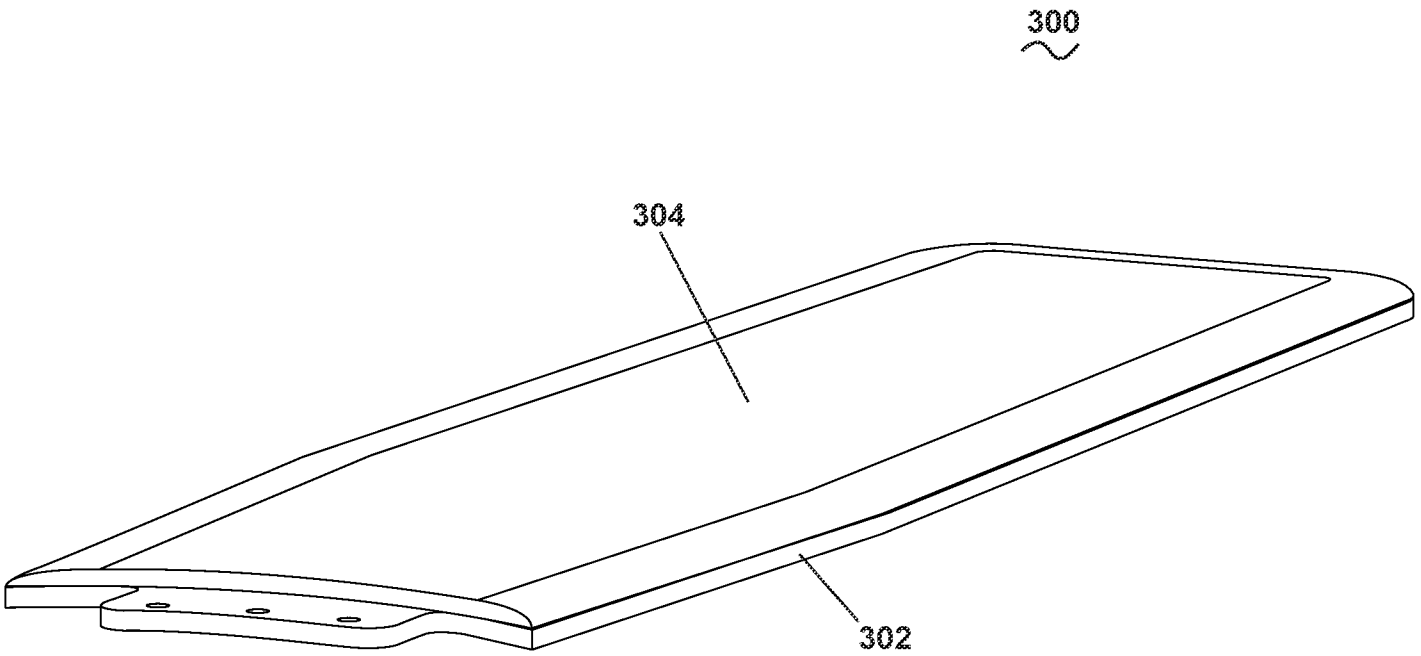
FIG. 9 is an assembled view of the blade of FIG. 8.

FIG. 9 illustrates a completed version of the blade 300 of FIG. 8, having the topper 304 secured to the blade base 302 to form the complete blade 300. While the blade is shown as having a diverging-then-converging shape in the chord-wise direction extending from root to tip, it should be appreciated that any blade shape is contemplated and may or may not include the blade iron mount extending from the root of the blade base 302. Additionally, it is contemplated that the topper 304 can also cover the iron portion of the blade base 302. While the topper 304 is described herein as a 'topper', it should be understood that it need not be a topper in a traditional sense as limited to attachment to a top of a blade base 302. It should be appreciated that a topper 304 can be any suitable pulp element attached to any portion of the blade base 302 to adapt the blade 300 to have an aerodynamic profile. An aerodynamic profile can be any suitable shape that improves aerodynamic performance of the blade 300 upon addition of the topper 304. Thus, a 'topper' as described herein could be added to the bottom of the blade to improve aerodynamic efficiency, in one non-limiting example.

Figure 10:
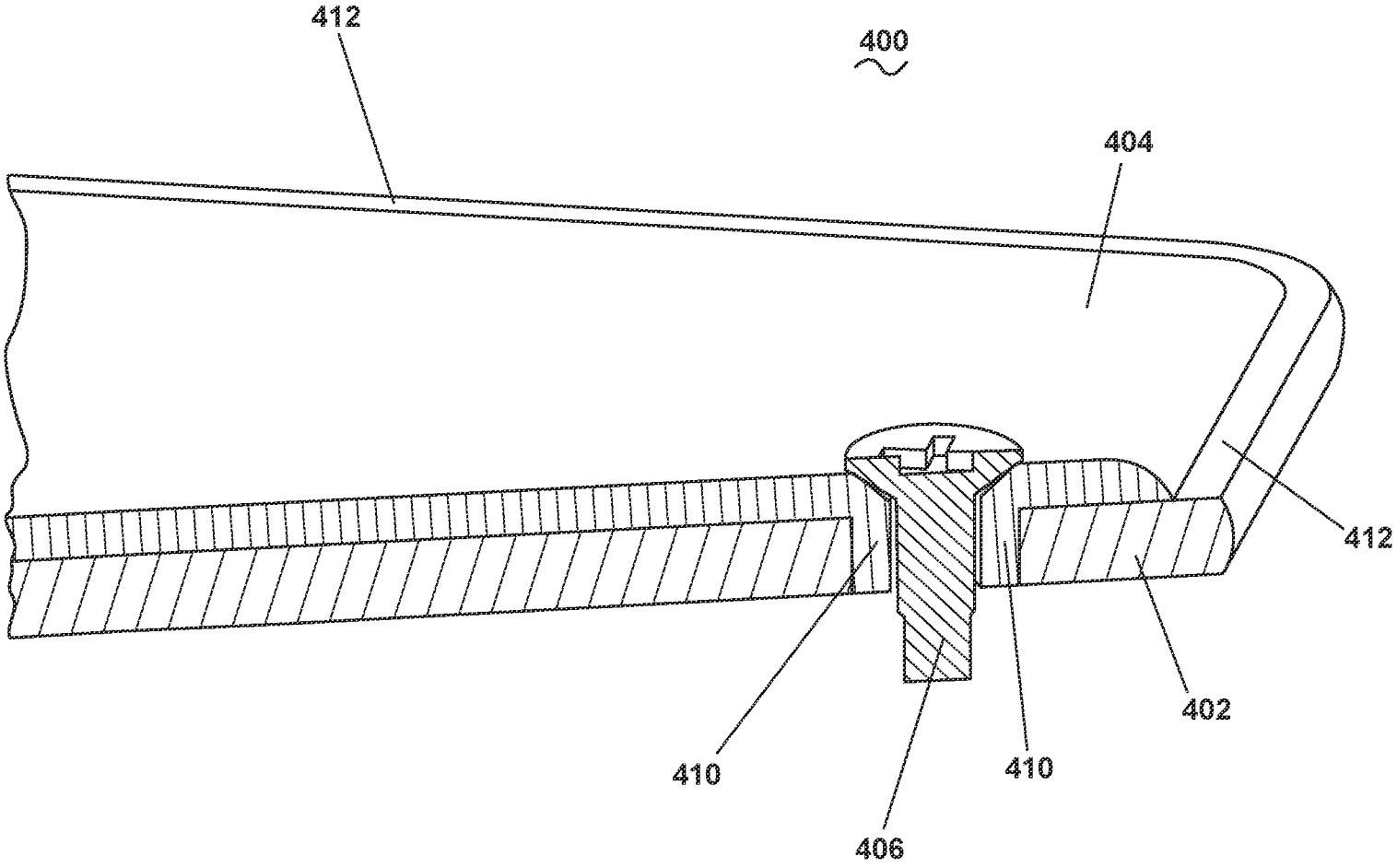
FIG. 10 is a section view of the blade of FIG. 9, showing a grommet design for the topper extending into the blade base.

Referring to FIG. 10, a first system for mounting and securing a topper 404 to a blade base 402 to form a ceiling fan blade 400 can include forming a grommet portion 410 that is integral with the topper 404 and sized to accept a fastener 406, such as a screw. While shown that the fastener 406 extends beyond the blade 400 at the bottom, it should be understood that the fastener 406 can be used to mount the blade 400 to the remainder of the ceiling fan, such as via a blade iron, to impart rotational movement to the blade 400. The grommet portion 410 extends from the remainder of the topper 404 and can be shaped to insert into a hole formed in the blade base 402, such as the mount holes 82 of FIG. 2, for example. The integral grommet design reduces overall parts, removing the need for an additional grommet. Additionally, utilizing the topper 404 with the grommet portion 410 mitigates any vibration generated by the blade 400 between the blade base 402 and the topper 404. In this way, vibration or blade balance issues which can negatively impact performance are reduced, minimized, or otherwise mitigated.

Additionally, the blade base 402 can be shaped as being wider, longer, or both, relative to the topper 404, defining an edge or boundary 412, fully or partially defined around the blade 400. Similarly, the topper 404 can be formed thinner and shorter than the base blade 402, which can provide for attaching the topper 404 onto an existing blade as the blade base 402, without extending over the edges of the blade base 402. The boundary 412 can provide for room for attaching the topper 404 to the blade base 402. Utilizing the boundary 412 can provide for seeing the aerodynamic benefits of the topper, while reducing the occasion that the topper 404 extends beyond the blade base 402, thereby reducing the instance of detachment of the topper or aerodynamic inefficiencies after installation. Additionally, the boundary 412 provides for preventing the topper 404 from creating a sharp zone on the blade edge.

Figure 11:
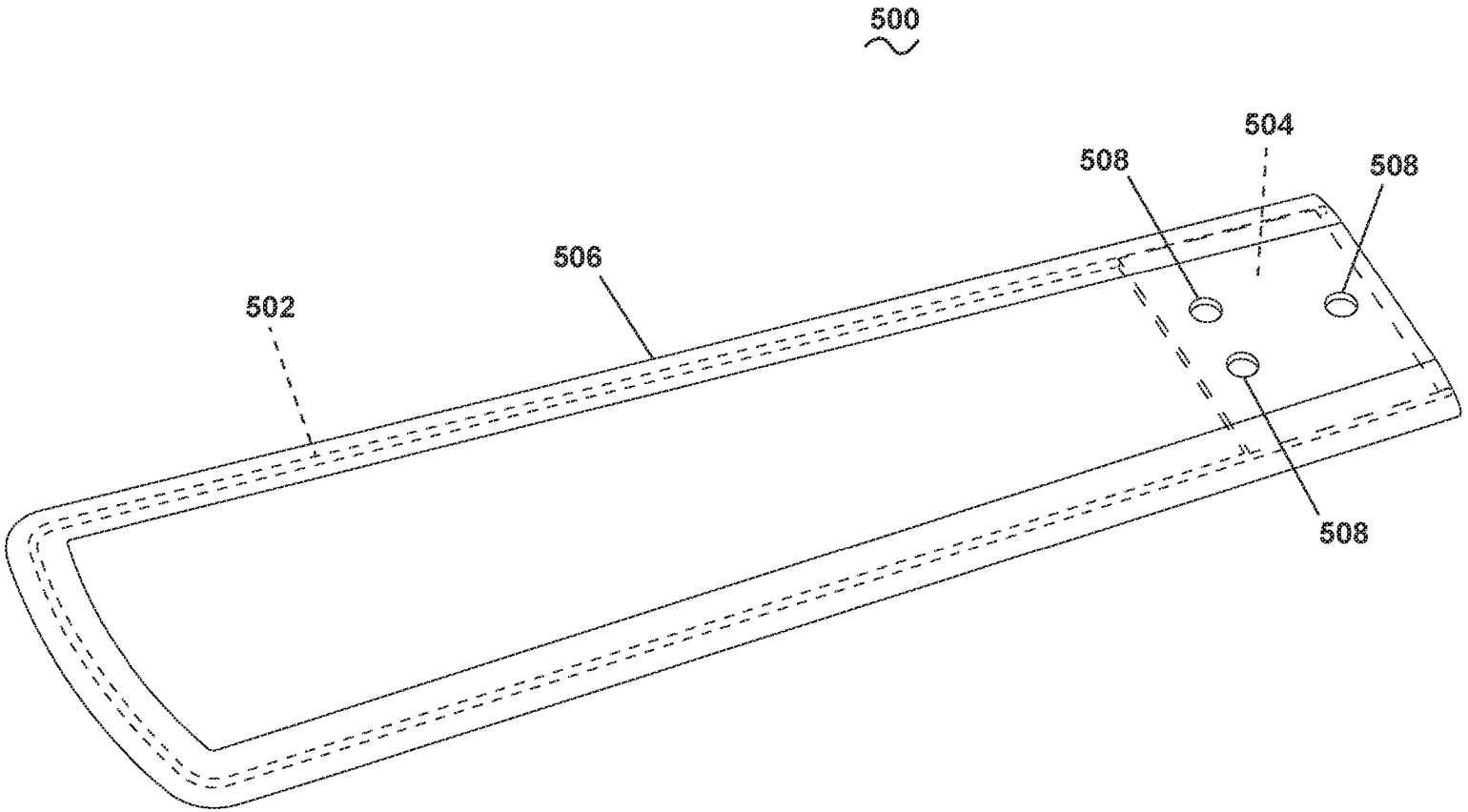
FIG. 11 is a view of another alternative blade for the set of blades of FIG. 1, including a wire frame.

Referring to FIG. 11, another exemplary blade 500 includes an interior wire frame 502 coupled to a plate 504 (the wire frame 502 and the plate 504 shown in broken line). In one example, the plate 504 can be welded to the wire frame 502, while any suitable method of attachment is contemplated. In one additional example, the wire frame 502 and the plate 504 can be integral or formed as a unitary structure, such as with casting.

The exterior of the blade 500 can include a pulp overlay 506, utilizing the wire frame 502 and the plate 504 as a skeleton supporting the pulp overlay 506. Alternatively, the pulp overlay 506 could be a foam or other material, covering, overlaying, or otherwise attached to and encasing the skeleton or wire frame 502. A set of mount holes 508 can be provided in the plate 504, providing for the attachment of a blade iron (not shown) to the blade 500 at the plate 504. The plate 504 provides a durable attachment point for mounting of a blade iron, such as the blade iron 36 of FIG. 1, for example. The wire frame 502 extends along the outer periphery of the blade 500 where the blade 500 experiences higher forces during rotational movement of the blades and ceiling fan operation.

Forming the pulp overlay 506 onto the skeleton of the wire frame 502 and the plate 504 provides or a structurally supported blade 500, that is light weight and can be formed to have aerodynamic features, such as an airfoil profile in one non-limiting example. The light blades with the aerodynamic features can provide for improved efficiency as well as reduced operational costs. Additionally, a pulp overlay provides for a blade 500 that is largely recyclable or has a reduced or minimal environmental impact, or at least compared to ceiling fan blades formed without a pulp overlay.

Figure 12:
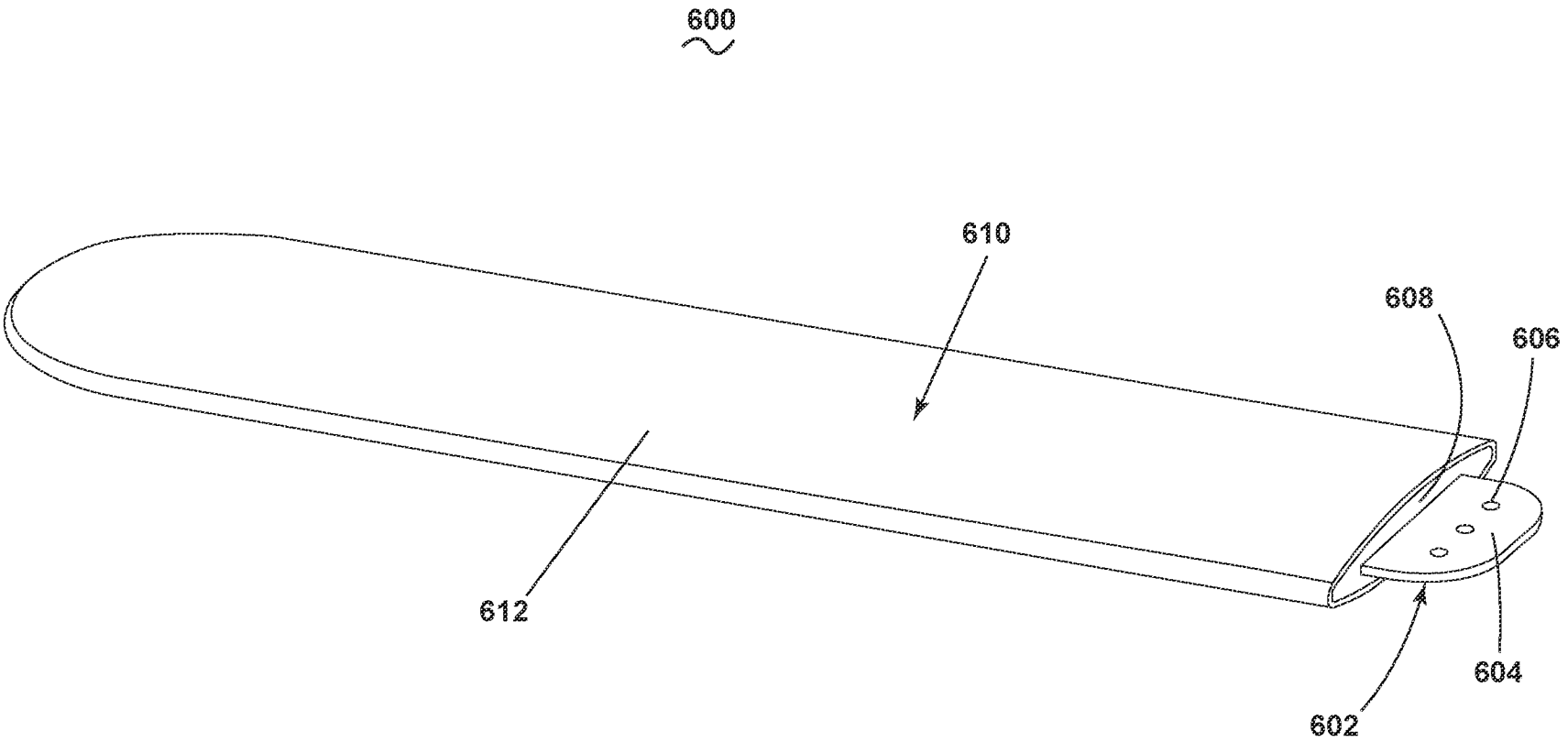
FIG. 12 is a view of yet another alternative blade for the set of blades of FIG. 1, having a blade mount, a foam core, and an overlay.

Referring to FIG. 12, another blade 600 includes a blade mount structure 602, such as a skeleton as described herein. The blade mount structure 602 can be a solid interior structure capable of supporting the blade 600 during rotating operation. In non-limiting examples, the blade mount structure 602 can be made of stamped metal or formed plastic. Additionally, the blade mount structure 602 can include a mount extension 604 including a set of mount holes 606 for attaching the blade 600 to a blade iron or rotor (not shown).

A core 608 is provided around the blade mount structure 602. The core 608 can be formed to have a three-dimensional blade shape, such as having an airfoil profile adapted to improve blade efficiency and airflow, as compared to a flat blade. In one example, the core 608 can be made of foam or other similar lightweight material, such as an open cell or closed cell foam.

A pulp overlay 610 can be formed around and covering the core 608. The pulp overlay 610 can provide for forming the blade shape based upon the core 608, and then covering the core 608 with the pulp to provide for a structurally stable blade. Additionally, it is contemplated that the pulp overlay 610 be coated with a blade coating 612 or coloring to decorate the blade, or improve structural integrity or aerodynamic efficiency with a low-friction surface, for example. The blade coating 612 can also be multiple coatings, such as a waterproofing coating, a color coating, or another coating to reduce aerodynamic drag in non-limiting examples. Thus, it should be understood that a myriad of coatings are contemplated for use with the blades as described herein.

The blades as discussed herein provide for decreased cost of manufacture, which results in a reduced cost to the consumer. Additionally, the blades can provide for increased aerodynamic efficiency, which provides for improved operational efficiency and reduced operational costs. Furthermore, the pulp used in forming the blades can be made from a biodegradable material, which can provide for a reduced environmental impact for the blades, as well as improved desirability for a consumer market that values environmental impacts and sustainability.

Figure 13:
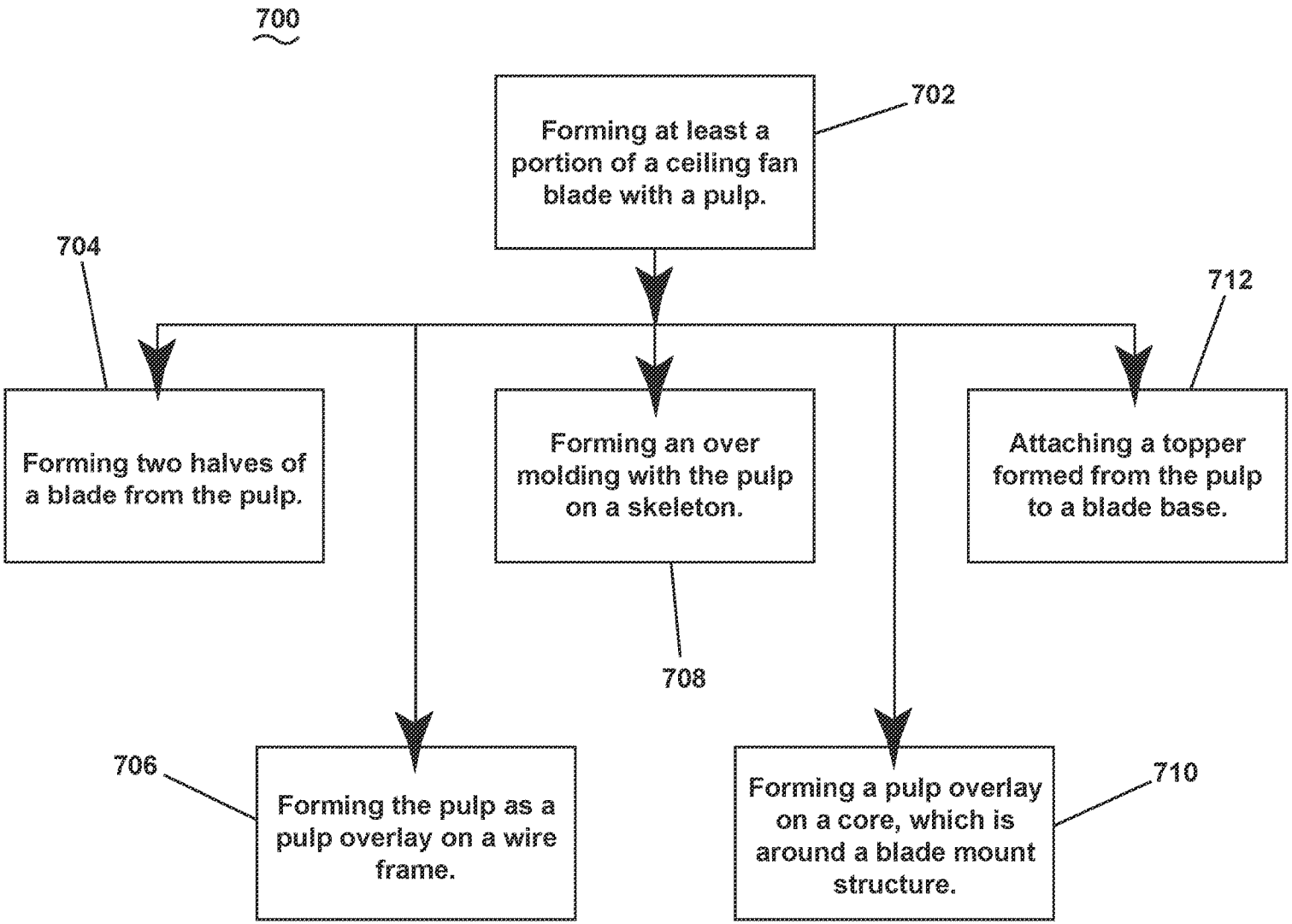
FIG. 13 is a flow chart illustrating a method of forming a blade for a ceiling fan.

Referring to FIG. 13, a method 700 of forming a blade can include, at 702, forming at least a portion of the blade utilizing a pulp. At 704, the method can further include where forming includes forming two halves of the blade from the pulp. One or both halves can be formed from the pulp. The method can further include attaching the two halves to one another. The two halves can be attached, for example, by the ribs 78 and the rib receptacles 70 of FIG. 2. Additionally, it is contemplated that the halves are connected by an integral hinge, such as a living hinge, which can also be made of the pulp material. Additionally, it is contemplated that the method 700 can include discretely forming each half of the blade from the pulp, such as taking a pulp material, such as a fibrous pulp, and mixing the pulp with a binding agent. After mixing the two, the pulp material with the binding agent can be compressed, such as within a mold to form the blades or portions thereof as described herein. In one example, the blade may be heated to cure the binding agent. It is also contemplated that the formation of the molded blade can be cured by pressure curing, or may be dried after manufacture.

At 706, the method 700 can further include where forming includes forming the pulp as a pulp overlay provided over a wire frame, such as the pulp overlay 506 over the wire frame 502 of FIG. 11. Additionally, a plate can be affixed to the wire frame to provide for additional stability for the blade, as well as providing a portion for mounting a blade iron to the blade, or mounting the blade to a rotor.

At 708, the method 700 can further include wherein forming the blade further includes forming an over molding with a pulp provided on a skeleton to form the blade. The over molding, for example, can be the over molding 220 provided over the skeleton 200 of FIGS. 4-7, for example. Alternatively, the skeleton may be the wire frame 502 of FIG. 11 with the over molding formed as the pulp overlay 506.

At 710, the method can further include where forming includes forming a core over a blade mount structure, and forming a pulp overlay over the blade mount structure. For example, the blade mount structure can be the blade mount structure 602 of FIG. 12. The core can be the core 608 of FIG. 12, and can be made of foam or another sturdy but lightweight material. Additionally, the pulp overlay 610 of FIG. 12 can be made from the pulp and covering the core 608. Furthermore, it is contemplated that a coating can be provided over the pulp overlay for sealing the blade, or for coloring or otherwise decorating the fan.

At 712, the method 700 can further include attaching a topper formed as pulp to a blade base to form the blade. For example, the base blade can be any blade, such as an existing blade having a flat top or flat bottom surface, or both. The topper can be the topper 404 of FIGS. 8-10, for example, and the blade base can be the blade base 402. Additionally, the method 700 can include where the topper forms an aerodynamic shape for the blade that is more efficient than that of the blade base alone. The method 700 can further include where the topper includes a grommet portion, which can be inserted into a mount hole in the base blade, which helps to dampen vibrations between the blade base and the topper.

The method as described herein should be considered as non-limiting in the order or arrangement as described. It should be understood that the aspects of the method can be mixed, reorganized, reordered, or that portions of one part of the method can be combined with other portions of the method.

Further aspects of the invention are provided by the subject matter of the following clauses:

A ceiling fan comprising: a motor including a rotor; a blade coupled to the rotor and rotatably driven by the motor, the blade comprising; a first portion defining a first interior surface for the blade; and a second portion secured to the first portion to form a complete body for the blade, with the second portion defining a second interior surface for the blade; wherein the blade is at least partially formed of a pulp.

The ceiling fan of any preceding clause wherein both the first portion and the second portion are formed completely from pulp.

The ceiling fan of any preceding clause wherein the first portion includes a set of ribs extending from the first interior surface.

The ceiling fan of any preceding clause wherein the second portion includes a set of rib receptacles configured to receive the set of ribs to secure the first portion to the second portion.

The ceiling fan of any preceding clause wherein the first portion further includes a set of stops.

The ceiling fan of any preceding clause wherein the second portion further includes a set of stop receptacles configured to receive the set of stops to define a thickness for the blade via the set of stops.

The ceiling fan of any preceding clause wherein the first portion and the second portion are connected by a hinge.

The ceiling fan of any preceding clause wherein the hinge is a living hinge formed from pulp.

The ceiling fan of any preceding clause wherein the first portion includes a set of mount holes.

The ceiling fan of any preceding clause wherein the second portion includes a set of mount receptacles arranged complementary to the set of mount holes when the first portion is joined to the second portion.

A blade for a ceiling fan, the blade comprising: a skeleton; an over molding formed around the skeleton; wherein the over molding is formed from a pulp.

The blade of any preceding clause wherein the skeleton includes a set of perforations facilitating adhesion of the over molding to the skeleton.

The blade of any preceding clause further comprising a set of ribs extending along the skeleton.

The blade of any preceding clause wherein the ribs extend along the skeleton from a first end to a second end.

The blade of any preceding clause wherein the over molding surrounds the entirety of the skeleton except for a portion of a root of the skeleton, wherein the portion of the root of the skeleton includes a set of mount holes.

The blade of any preceding clause wherein the skeleton includes a wire frame extending around at least a portion of the periphery of the blade.

The blade of any preceding clause wherein the skeleton further includes a plate attached to the wire frame.

The blade of any preceding clause further comprising a foam core provided on the skeleton, with the over molding provided on the foam core.

A blade for a ceiling fan comprising: a blade base having an upper surface and a lower surface, and extending span-wise between a root and a tip, and extending chord-wise between a first edge and a second edge; a topper attached to the blade base to form the blade, with the topper at least partially formed from a pulp.

The blade of any preceding clause wherein the topper further includes a grommet portion.

The blade of any preceding clause wherein the blade base further includes a mount hole and the grommet portion inserts into the mount hole.

The blade of any preceding clause wherein the topper includes a chord-wise width that is less than that of the blade base between the first edge and the second edge such that a peripheral edge is defined along the upper surface of the blade base not covered by the topper.

A blade for a ceiling fan comprising: a blade mount structure; a core surrounding and affixed to the blade mount structure; and a pulp overlay provided on the core.

The blade of any preceding clause further comprising a coating provided on the pulp overlay.

The blade of any preceding clause wherein core is made of an open cell foam.

The blade of any preceding clause wherein a portion of the blade mount structure extends from the core and includes a set of mount holes.

A method of forming a blade for a ceiling fan, the method comprising: forming at least a portion of the blade by utilizing a pulp.

The method of any preceding clause wherein forming further comprises forming two halves of the blade from the pulp.

The method of any preceding clause further comprising attaching the two halves to form the blade.

The method of any preceding clause wherein the two halves are integral, attached by a common hinge.

The method of any preceding clause wherein forming further includes forming an over molding with the pulp on a skeleton to form the blade.

The method of any preceding clause wherein forming further includes attaching a topper formed from the pulp to a base blade.

The method of any preceding clause wherein attaching the topper forms an aerodynamic shape for the blade that is more efficient than that of the base blade without the topper.

The method of any preceding clause further comprising dampening vibrations with a grommet portion integral with the topper.

The method of any preceding clause wherein forming further comprises forming the pulp as a pulp overlay provided on a wire frame.

The method of any preceding clause further comprising stabilizing the pulp overlay on the wire frame with a plate coupled to the wire frame interior of the pulp overlay.

The method of any preceding clause wherein forming further comprises forming a pulp overlay about a core, which is formed around a blade mount structure.

To the extent not already described, the different features and structures of the various aspects can be used in combination, or in substitution with each other as desired.

That one feature is not illustrated in all of the examples is not meant to be construed that it cannot be so illustrated, but is done for brevity of description. Thus, the various features of the different aspects can be mixed and matched as desired to form new aspects, whether or not the new aspects are expressly described. All combinations or permutations of features described herein are covered by this disclosure. Therefore, it should be understood that it is contemplated that features of one embodiment may be applied to another embodiment, and interchanged, added, or removed to form additional embodiments not explicitly shown, but still within the scope of the disclosure.

Although the embodiment of the present invention have been shown and described, it would be appreciated by those skilled in the art that changes may be made in these embodiments without departing from the principles and spirit of the invention. Although specific terms are employed herein, they are used in a generic and descriptive sense only and not for purposes of limitation.

What is claimed is:

1. A ceiling fan assembly comprising:

a motor having a rotor with a blade mount;

a mount for coupling to a structure and for suspending the motor; and a ceiling fan blade comprising a molded pulp blade body made of a compressed molded pulp slurry.

2. The ceiling fan assembly of claim 1, wherein the molded pulp slurry is made from one of a recycled material or biodegradable material.

3. The ceiling fan assembly of claim 1 wherein the ceiling fan blade further comprises a ceiling fan blade base and a topper, which attaches to the ceiling fan blade base, with the topper at least partially formed from the molded pulp slurry.

4. The ceiling fan assembly of claim 3 wherein the topper further includes a grommet portion extending into a mount hole of the ceiling fan blade base.

5. The ceiling fan assembly of claim 3 wherein the topper is smaller than the ceiling fan blade base defining a peripheral edge along at least a portion of the ceiling fan blade base that is unoccupied by the topper.

6. A ceiling fan assembly comprising:

a motor;

a mount for coupling to a structure and for suspending the motor;

a ceiling fan blade comprising a blade body for coupling to the motor, wherein the ceiling fan blade is a molded pulp formed from a compressed molded pulp slurry, and includes a foam core, and the molded pulp is formed about at least a portion of the foam core.

7. The ceiling fan assembly of claim 6 wherein the molded pulp comprises at least one of paper fibers, plant fibers, or wood fibers.

8. The ceiling fan assembly of claim 6 wherein the molded pulp is compressed.

9. A ceiling fan assembly comprising:

a motor;

a mount for coupling to a structure and for suspending the motor;

a ceiling fan blade comprising a blade body for coupling to the motor, wherein the ceiling fan blade is formed from a molded pulp and includes a skeleton, and the molded pulp is formed about at least a portion of the skeleton;

wherein the ceiling fan blade is formed of a first portion and a second portion, with each of the first portion and second portion including an interior surface, collectively defining an interior for the ceiling fan blade and the skeleton is located within the interior;

wherein the first portion comprises an upper half and the second portion comprises a lower half; and wherein the upper half and lower half are connected by a hinge.

10. The ceiling fan assembly of claim 9 wherein the molded pulp comprises at least one of paper fibers, plant fibers, or wood fibers.

11. The ceiling fan assembly of claim 9 wherein the skeleton includes a set of perforations to facilitate adhesion of the molded pulp to the skeleton.

12. The ceiling fan assembly of claim 9 wherein the molded pulp is compressed.

13. The ceiling fan assembly of claim 9 wherein one of the first portion or the second portion further includes a set of stops.

14. The ceiling fan assembly of claim 13 wherein the first portion or the second portion that does not include the set of stops, includes a set of stop receptacles, with the set of stop receptacles adapted to receive the set of stops.

15. The ceiling fan assembly of claim 9 wherein the skeleton comprises a wire frame.

16. The ceiling fan assembly of claim 15 wherein the wire frame extends around a periphery of at least a portion of the blade.

* * * * *